US010316556B2

(12) United States Patent
Richmond

(10) Patent No.: US 10,316,556 B2
(45) Date of Patent: Jun. 11, 2019

(54) DOOR BARRICADE

(71) Applicant: Campus Safety Products, LLC, Durham, NC (US)

(72) Inventor: Matthew Todd Richmond, Dumphries, VA (US)

(73) Assignee: Campus Safety Products, LLC, Durham, NC (US)

( * ) Notice: Subject to any disclaimer, the term of this patent is extended or adjusted under 35 U.S.C. 154(b) by 0 days.

(21) Appl. No.: 15/957,499

(22) Filed: Apr. 19, 2018

(65) Prior Publication Data

US 2018/0238085 A1 Aug. 23, 2018

Related U.S. Application Data

(63) Continuation-in-part of application No. 15/005,509, filed on Jan. 25, 2016.

(51) Int. Cl.
*E05C 1/04* (2006.01)
*E05C 5/00* (2006.01)
(Continued)

(52) U.S. Cl.
CPC ..... *E05C 5/02* (2013.01); *E05C 19/004* (2013.01); *E05C 21/00* (2013.01); *G08B 13/08* (2013.01); *G08B 25/10* (2013.01); *E05B 63/18* (2013.01); *E05C 1/04* (2013.01); *E05C 5/00* (2013.01); *E05C 17/00* (2013.01); *E05C 17/12* (2013.01); *E05C 17/16* (2013.01); *E05C 17/44* (2013.01); *E05C 17/443* (2013.01); *E05C 17/46* (2013.01);
(Continued)

(58) Field of Classification Search
CPC ..... E05C 17/00; E05C 17/44; E05C 17/048; E05C 17/50; E05C 17/46; E05C 17/443; E05C 19/003; E05C 5/00; E05C 19/18; E05C 19/184; E05C 17/06; E05C 17/12; E05C 17/16; E05C 19/004; E05C 19/00; Y10T 292/65; Y10T 292/67; Y10T 292/083; Y10T 292/37; Y10T 292/71; Y10T 292/73; Y10T 292/0891; G08B 25/10; G08B 13/08
USPC .... 292/28, 289, 342, 343, DIG. 15, 67, 338, 292/339, 148, 137
See application file for complete search history.

(56) References Cited

U.S. PATENT DOCUMENTS 365,038 A 6/1887 Andres
712,270 A 10/1902 Dilthey et al.
(Continued)

FOREIGN PATENT DOCUMENTS

CA 1279674 C 1/1991
CA 1302786 C 6/1992
(Continued)

OTHER PUBLICATIONS

Door Jammer./ Portable Door Security Device, Amazon.com, http://www.amazon.com/Door-Jammer-Portable-Security-Device/sim/B00BZB97AM/2, Apr. 26, 2015.
(Continued)

*Primary Examiner* — Kristina R Fulton
*Assistant Examiner* — Faria F Ahmad
(74) *Attorney, Agent, or Firm* — James G. Passé; Passé Intellectual Property, LLC

(57) ABSTRACT

The present invention is a door barricade having a pivoting locking arm which drops into a floor hole to lock a barricade in place.

6 Claims, 3 Drawing Sheets

(51) Int. Cl.

| | |
|---|---|
| ***E05C 5/02*** | (2006.01) |
| ***E05B 63/18*** | (2006.01) |
| ***E05C 17/00*** | (2006.01) |
| ***E05C 17/12*** | (2006.01) |
| ***E05C 17/16*** | (2006.01) |
| ***E05C 17/44*** | (2006.01) |
| ***E05C 17/46*** | (2006.01) |
| ***E05C 17/50*** | (2006.01) |
| ***E05C 19/00*** | (2006.01) |
| ***E05C 19/18*** | (2006.01) |
| ***E05C 21/00*** | (2006.01) |
| ***G08B 13/08*** | (2006.01) |
| ***G08B 25/10*** | (2006.01) |

(52) U.S. Cl.

CPC ..... *E05C 17/50* (2013.01); *E05C 19/002* (2013.01); *E05C 19/003* (2013.01); *E05C 19/18* (2013.01); *E05C 19/184* (2013.01); *Y10T 292/0891* (2015.04); *Y10T 292/37* (2015.04); *Y10T 292/65* (2015.04); *Y10T 292/67* (2015.04); *Y10T 292/71* (2015.04); *Y10T 292/73* (2015.04)

(56) References Cited

U.S. PATENT DOCUMENTS 1,448,298 A 3/1923 George
1,505,184 A 8/1924 Zukor
1,589,149 A 6/1926 Hanle
1,605,208 A 11/1926 Blakely
1,721,257 A 7/1929 Myers
1,723,007 A 8/1929 Bittorf
2,153,232 A 4/1939 Beck
2,396,982 A 3/1946 Bousquet
2,403,065 A 7/1946 Engret
2,764,442 A 9/1956 Weaver
3,024,056 A * 3/1962 Cook ..... E05C 17/446 292/177
3,336,075 A 8/1967 Wilson
3,351,122 A 11/1967 Murphy
3,399,918 A 9/1968 Nagy
3,791,687 A 2/1974 Schroeder
3,861,726 A 1/1975 McLennan
4,050,723 A 9/1977 Papadatos
D255,212 S 6/1980 Weigand et al.
4,322,100 A * 3/1982 McLennan ..... E05C 3/048 292/67
4,666,195 A * 5/1987 Thomas, III ..... E05C 17/443 292/336.3
4,671,014 A 6/1987 Lack
4,759,577 A * 7/1988 Thomas, III ..... E05C 17/443 292/338
4,854,791 A 8/1989 Brown
5,040,835 A * 8/1991 Barker ..... E05C 19/004 292/338
5,114,193 A 5/1992 Nass
5,253,905 A 10/1993 Hutson
5,395,143 A 3/1995 Chesterton
5,398,982 A * 3/1995 Watson, Jr. ..... E05C 3/048 292/259 R
5,407,240 A 4/1995 Andre et al.
5,454,610 A 10/1995 Taylor et al.
5,473,841 A 12/1995 Grillo
5,489,129 A 2/1996 Shepherd
5,490,304 A 2/1996 Winner, Jr. et al.
5,531,490 A * 7/1996 Parker ..... E05C 17/04 16/82
5,539,954 A 7/1996 Ambar
5,590,918 A * 1/1997 Kambalov ..... E05C 17/00 16/82
5,618,072 A * 4/1997 Pitchford ..... E05C 19/004 292/339
5,692,787 A 12/1997 Young
5,711,555 A * 1/1998 Leedy ..... E05C 19/184 292/202
5,836,049 A 11/1998 Chiang
5,934,116 A * 8/1999 Moore ..... E05B 67/383 292/218
5,983,680 A 11/1999 Del Nin
5,992,909 A * 11/1999 Vindum ..... E05C 17/042 292/258
6,032,329 A 3/2000 Casali
6,149,209 A 11/2000 Barton
6,161,252 A 12/2000 Rodriguez
6,308,996 B1 10/2001 Ganimian
6,321,411 B1 11/2001 Ikejiri et al.
6,340,185 B1 1/2002 Truong
D453,470 S 2/2002 Prasad
6,471,264 B1 * 10/2002 Ryan ..... E05C 1/04 292/251.5
6,557,912 B1 5/2003 Truong
6,782,724 B2 8/2004 Kelly
7,014,229 B1 3/2006 Stelmach
7,216,902 B2 5/2007 Marra et al.
7,513,542 B2 4/2009 Schumm
8,210,504 B1 7/2012 Skornickel
8,250,811 B2 8/2012 Zijlstra
8,382,169 B2 2/2013 Bosshard
8,403,382 B2 3/2013 Della-Santa
8,414,040 B1 * 4/2013 Rhodes ..... E05B 53/003 292/288
8,794,681 B2 8/2014 Crosse
8,894,110 B2 11/2014 Taylor et al.
9,238,926 B2 1/2016 Guerrero et al.
9,470,032 B2 10/2016 Swanberg
2004/0070217 A1 * 4/2004 Demlow ..... E05C 17/443 292/339
2004/0181902 A1 * 9/2004 Pierce ..... E05C 17/443 16/49
2006/0043739 A1 * 3/2006 Gogel ..... E05B 17/2023 292/148
2007/0000293 A1 1/2007 Daniels et al.
2008/0127457 A1 * 6/2008 Deng ..... E05C 17/443 16/402
2009/0322473 A1 * 12/2009 Aliferis ..... E05B 47/026 340/5.7
2011/0291426 A1 12/2011 Gibson
2011/0304164 A1 12/2011 Salo et al.
2012/0056438 A1 * 3/2012 Enderle ..... E05C 17/50 292/194
2014/0217754 A1 * 8/2014 Taylor ..... E05C 19/184 292/288
2014/0312634 A1 10/2014 Cushwa et al.
2015/0211269 A1 * 7/2015 Gehrke ..... E05C 17/48 292/338
2016/0186470 A1 * 6/2016 Finley ..... E05C 19/18 292/339
2016/0215538 A1 * 7/2016 Pistone ..... E05C 17/443
2018/0148960 A1 * 5/2018 Finley ..... E05C 19/003
2018/0158268 A1 * 6/2018 Comerford ..... G08B 13/06

FOREIGN PATENT DOCUMENTS

WO 1988003216 A1 5/1988
WO 2014121154 A1 8/2014

OTHER PUBLICATIONS

Nightlock, https://www.youtube.com/watch?v=YBIQP6uFp-I, http://nightlock.com/ , Apr. 26, 2015.

* cited by examiner

DOOR BARRICADE

This application is a continuation-in-part of U.S. non-provisional application Ser. No. 15/005,509 filed on Jan. 25, 2016, and which is incorporated herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a door safety barricade. In particular, the present invention relates to a device for barricading a door from the inside during an emergency situation.

Description of Related Art

The more frequent occurrence of intruders in schools, businesses and government facilities has highlighted safety needs for people working at or using such facilities, such as students in a school. Schools and other facilities are constantly attempting to prevent an intruder from entering classrooms, offices, and the like. In an intruder situation, many places go into a lockdown situation where people remain in place. The responders can take an average of 18 minutes before they can reach the situation if no security is readily present and, as such, keeping the occupants of a room safe from entry by an intruder is the critical effort while waiting for responders. An effective door barricade is needed to allow time for the responders to arrive and protect the room occupants.

In schools, and most buildings, there are many kinds of doors. Some swing outward, while others swing inwards. In addition, some doors are double doors that open in the middle of the two doors, either in or out. In addition, many schools and the like do not allow door locks on the interior. Where there are door locks, they require going outside the classroom in the hallway into the line of danger in order to utilize the door lock.

Many rooms in these situations have a window in the door, or next to the door, making it relatively easy to break the window and reach in to the door knob and unlock and open the door.

The devices attempting to deal with the situation have used various approaches. There are devices that attach to the door jamb, but the door can still easily be kicked in and break the door jamb. There are a number of devices that attach between the inside face of the door and the floor, but they all have a removable pin, key or the like, which can be lost or stolen, rendering the device useless in an emergency.

BRIEF SUMMARY OF THE INVENTION

The present invention relates to a door barricade mounting between the interior face of the door and the adjacent floor that succeeds in overcoming the problems of the previous attempts at barricading the door. It allows for an individual to instantly barricade the door and barricade it in such a way that no parts can be lost and that it is difficult or impossible to tamper with from the outside without a specialized tool in the hands of responders. The door barricade can be engaged on doors without door handles and without having to open the door first.

Accordingly, the present invention relates to a door barricade for a door having an interior face and an exterior face designed for use on the interior face and locking in an adjacent floor comprising:

a) a straight vertical bolt capable of rotating circumferentially and moving up and down to an upper and lower position of a length that does not reach the floor when the bolt is in a down position attached to the barricade in spaced relationship to the interior face of the door;

b) a floor plate with a receiver hole for attaching to a surface of the adjacent floor;

c) a locking arm attached to the vertical bolt having a locking foot at the bottom of the locking arm plate extending below a bottom of the straight vertical bolt, the foot in spaced relationship to the vertical bolt and locking into the adjacent floor receiver hole when the bolt is in the down position; and d) a wireless electronic device which can send emergency information to a desired location.

DETAILED DESCRIPTION OF THE INVENTION

Figure 1:
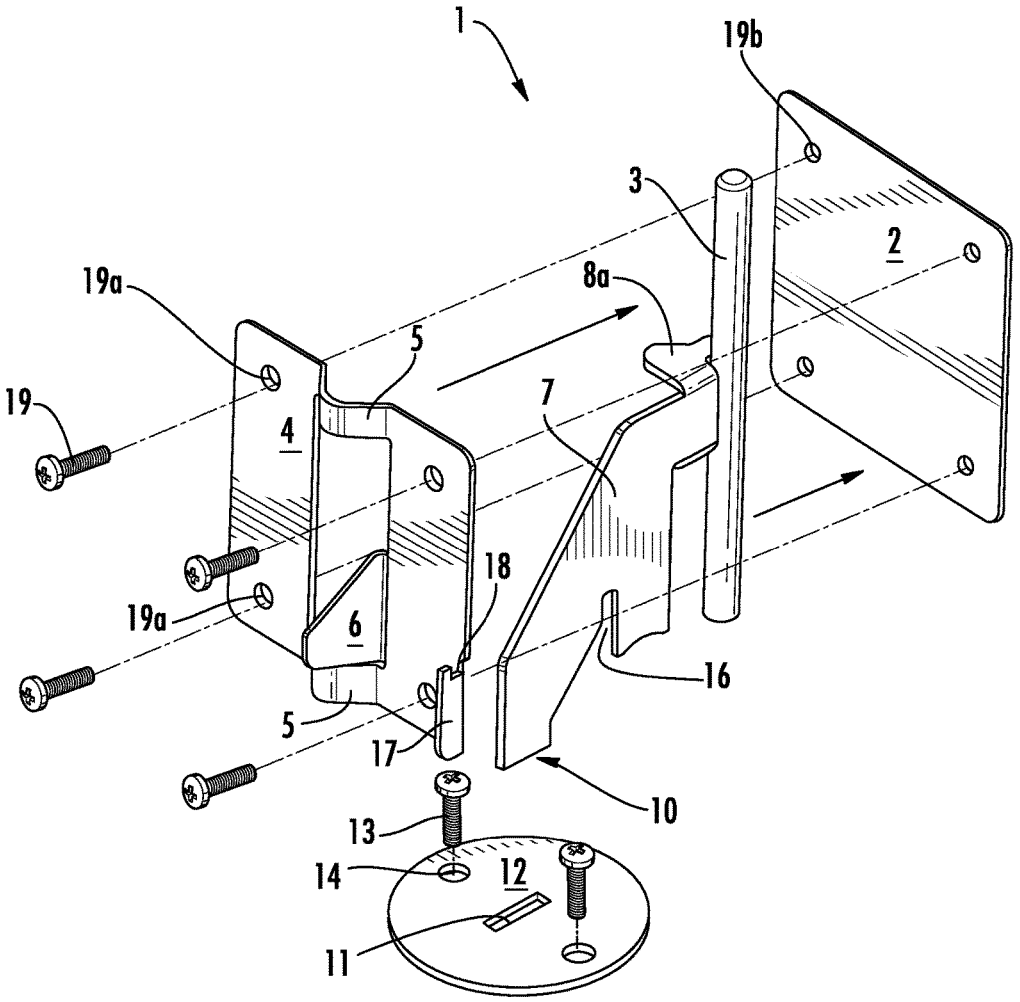
FIG. 1 is an exploded perspective view of the door barricade.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the phrase "door barricade" refers to a mechanism which can secure and fortify an entryway door to withstand an attempt to gain entry by force. In the case of the present invention, it is easily engaged and works regardless of other conventional locking mechanisms. The present invention door barricade is a device that mounts both on the interior face of a room door (such as a classroom) and on the adjacent floor to the interior face of the door, preventing opening of the door by the connection of the door to the floor.

As used herein, the phrase "interior face of the door" refers to the side of a room door, such as a classroom, which faces the interior of the room. The exterior face is the opposite side of the door where a person would approach to gain entry such as from the outside or a hallway into a classroom.

As used herein, the phrase "adjacent floor" refers to the floor in the room closest to the interior face of the door. This can be clearly seen in the drawings and is clear from the description herein.

As used herein, the phrase "door interior face mounting plate" refers to a plate mounted against the interior face of the door to be barricaded. It acts to help attach the front plate to the door, and acts to prevent access to the device from the outside by going through the door. The mounting plate can be made from any sufficiently strong metal, or reinforced other material, to resist damage or breaking. It therefore can be steel (e.g. rolled steel), titanium, thick aluminum, or the like.

As used herein, the phrase "front plate" refers to a second plate which mounts onto the mounting plate and is designed in such a fashion that a vertical bolt is held between both the mounting plate and the front plate in a manner that allows the bolt to move up and down, as well as circumferentially in both directions (clockwise and counter-clockwise). It is also made of steel, thick aluminum, or other rigid sturdy metal. The bolt can be held loosely, as in the figures, by providing two or more wrap around positions that form a cylindrical opening between the two plates for operation. One could envision other means or larger, smaller, or more such bands to hold the vertical bolt in view of the drawings and description herein.

As used herein, the phrase "vertical bolt" refers to a metal pin or bar that is positioned vertically in-between the front and mounting plates. The bolt is held between the two plates such that it can move up and down between a down position and an up position and is therefore long enough to accomplish that feat. As shown in the figures, the vertical bolt is longer than the two plates, but the plates could be longer and thus the bolt could be of similar height as the plates. Again, the bolt can be steel, aluminum or other rigid material or metal.

As used herein, the phrase "floor plate with a receiver hole" refers to a metal plate mounted into the adjacent floor by screwing, bolting, or the like, so that it is fixed in position. It has a hole in it, such as a round, rectangular or slot-like hole, as a receiving hole to receive the foot of the locking arm holding it in place on the floor.

As used herein, the phrase "locking arm" refers to an arm that is attached, such as by welding, to the vertical bolt, such that it travels up and down as the bolt travels from its up position to a down position. There is a locking foot at the bottom of the locking arm, such that when the bolt is in the lower position, the foot extends about to the floor. It is designed of a shape to fit into the hole in a receiver plate in the floor, and thus creates a locked position to barricade the door. In the down and locked position the vertical bolt is kept from moving circumferentially. In one embodiment, the foot is of a shape that will fit into a slot (as shown in the Figures). Because there is the plates (and the door) behind the bolt, the locking arm and the bolt can only rotate 180 degrees, from against the plates on one side to the other, as can be seen in the figures. In general, the down position will have the locking arm essentially perpendicular to the plates and the interior door face, since this is the strongest position for resisting force from the exterior face of the door.

As used herein, the phrase "restrictor plate" refers to processes, ridges, tabs or the like that keep the arm from rotating circumferentially when it is in the down position. They can be on the locking arm, or on the front plate, or as desired. The restrictor plates are positioned as well to allow rotation circumferentially when in the up position, and to allow the locking arm to rotate against the mounting plate and keep it folded out of the way when not in use. In one embodiment, shown in the Figures, the locking arm only rotates against the right side and not the left side but other versions are clearly possible in view of these drawings.

As used herein, the phrase "rest plate" refers to a tab or the like to assist or rest the locking arm in the up position. In one embodiment shown in the figures, there is a plate mounted on the mounting plate and a slot on the arm which are matched, allowing the arm to rest on the rest plate and hold it in position when not in use.

Other features could optionally be added to the device, including a lifting tab to aid in raising and lowering the locking arm and bolt from the upper position to the lower position, instructions for use, and signs indicating when the device is in active use. Screws with special heads which resist removal, emergency information and the like.

As used herein, the phrase "emergency information" refers to information on the status of the barricade (engaged/not-engaged), location of the barricade, and the like or any other information regarding an emergency which requires using the barricade. The information can be written (e.g. a sign that says "engaged" or "active") or in a digital manner (e.g. electronic device that gives emergency information). In one embodiment, the electronic device has wireless broadcasting capabilities which enable emergency information to be sent to a desired location (e.g. wifi or phone capabilities) that the desired device is engaged, the location of the device, and the like. In another embodiment, the emergency information is disseminated via a 2-way communication device in the wireless device for contacting someone at a location remote to the barricade. The electronic device can be engaged as shown in the Figures, but any method is contemplated, such as a button, physical switch, magnet, optical sensor, or the like. One skilled in the art could determine other methods of engagement in view of this disclosure.

DETAILED DESCRIPTION OF DRAWINGS

Now referring to the drawings, FIG. 1 is a perspective exploded view of the door barricade of the present invention. In this view, door barricade 1 comprises door face mounting plate 2 for mounting on the interior face of a door. Vertical bolt 3 is positioned between a front plate 4 and the mounting plate 2 for holding the vertical bolt vertically and allowing it to move from an up position to a down position. Holding bars 5 hold the bolt 3 from moving forward. Front plate 4 also has right restrictor plate 6 designed to keep the locking arm 7 from rotating to the right when it is in the down position. Vertical bolt 3 has locking arm 7 welded to it, so that they act as one piece. Left restrictor plate 8*a* keeps the bolt 3 from rotating left in the down position, and also acts as a tab to grab and assist raising and lowering the bolt from the upper to the lower position.

Locking arm 7 has foot 10, which has a rectangular shape for fitting into slot type hole 11 in floor plate 12, which is screwed by screws 13 by holes 14 into a floor adjacent to the interior face of a door. When raised into an upper position slot 16 on arm 7 fits on the slot 18 on rest plate 17. Front plate 4 is attached to mounting plate 2 and a door (see other figures) via screws 19 in holes 19*a* and 19*b*.

Figure 2:
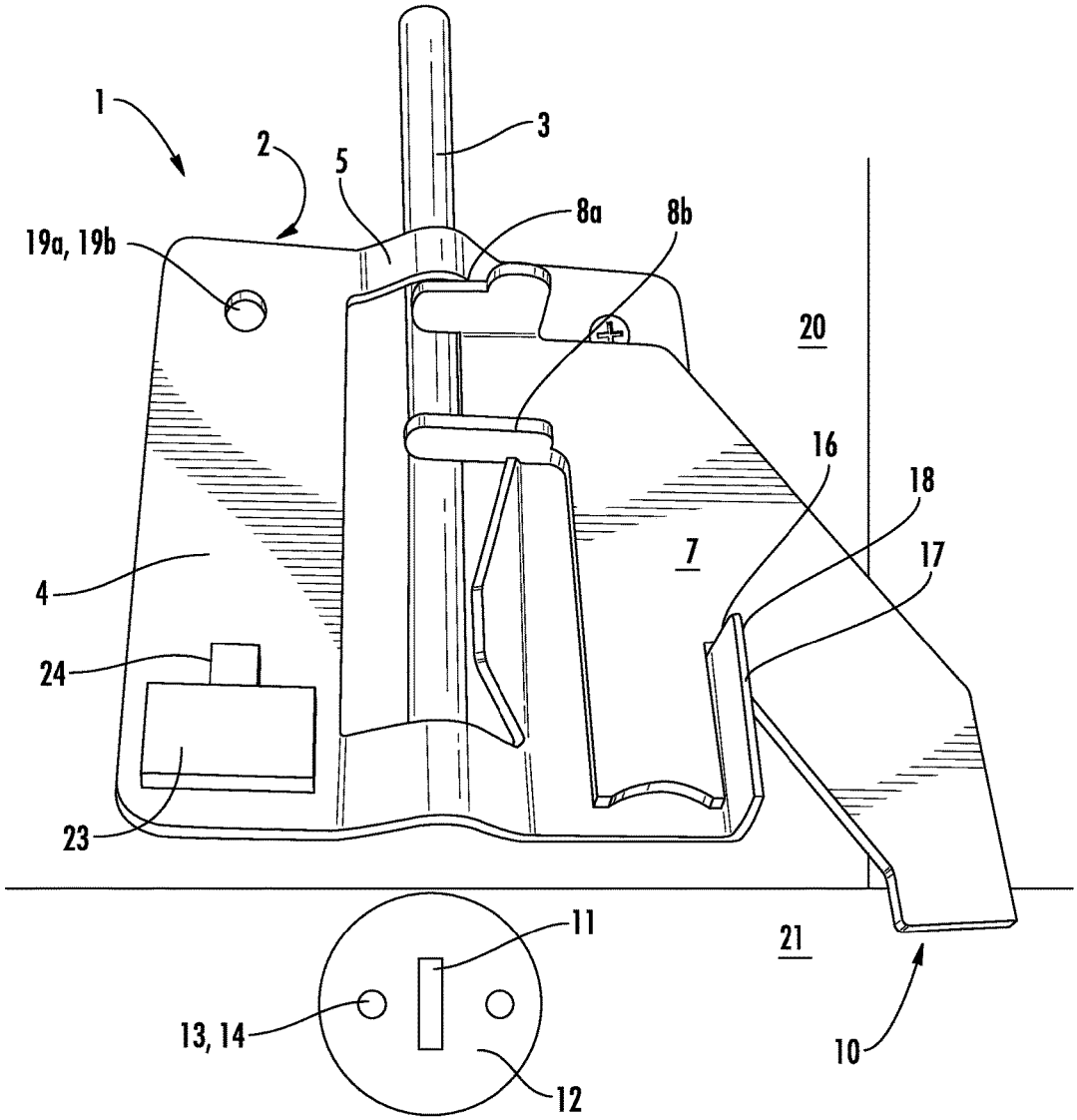
FIG. 2 is a frontal view of the device mounted between a door and floor in the open and up position.

FIG. 2 is a frontal view of device 1 mounted on door 20 and adjacent floor 21 in an open position, with the slot 16 of arm 7 resting on slot 18 of rest plate 17. A second left restrictor plate 8*b* is also shown in this view. FIG. 2 also includes a wireless electronic device 23 which is engaged when restrictor plate 8*a* is lowered into on/off button 24. It is, again, noted any method can be used to engage the electronic device such as a button, physical switch, magnetic switch, optical sensor, and the like. Electronic device 23 wirelessly sends emergency information that the device is engaged and where the device is located to a desired location (e.g. main office, police, and the like). In this view, it is also capable of a 2-way wireless communication with a remote location.

Figure 3:
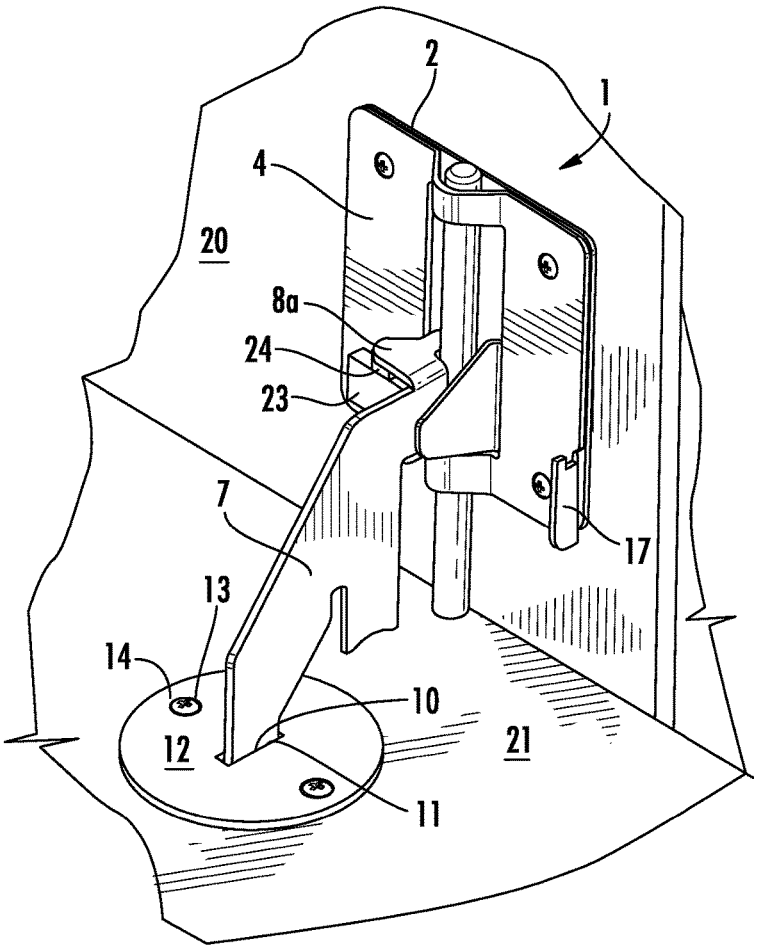
FIG. 3 is a perspective view of the device mounted between door and floor in the locked and down position.

FIG. 3 shows a perspective view of device 1 in the down locked position, wherein foot 10 is inserted in slot 11 and the bolt is kept from moving circumferentially by the restrictor plates. In this embodiment, restrictor plate 8*a* has compressed button 24 turning on the electronic device 23 and automatically sending emergency information (e.g. the device is engaged and information as to where the device is located) to the desired location and turning on a 2-way communication device.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A door barricade for a door having an interior face and an exterior face designed for use on the interior face and locking in an adjacent floor comprising:

a) a straight vertical bolt capable of rotating circumferentially and moving up and down to an upper and lower position of a length that does not reach the floor when the bolt is in a down position attached to the barricade in spaced relationship to the interior face of the door;

b) a single floor device with a receiver hole for attaching to the adjacent floor;

c) a locking arm fixedly attached to the vertical bolt having a locking foot fixedly attached to the locking arm extending below a bottom of the straight vertical bolt, the foot in a fixed horizontal spaced relationship to the vertical bolt and capable of locking only into the single adjacent floor receiver hole when the bolt is in the down position; and d) a wireless electronic device which can show or send emergency information to a desired location.

2. The door barricade according to claim 1 wherein the emergency information comprises at least one of information that the device is engaged and location of the device.

3. The door barricade according to claim 1 which further comprises a wireless 2-way communication device.

4. The door barricade according to claim 1 wherein the wireless electronic device can be engaged with a device selected from the group consisting of a physical switch, a button, a magnetic switch, and an optical sensor.

5. The door barricade according to claim 1 wherein there is a door interior face mounting plate for attachment to the interior face of the door, with the straight vertical bolt mounted in front of the face mounting plate.

6. The door barricade according to claim 1 wherein there is at least one restrictor plate to keep the locking arm from rotating when it is in the down position.

* * * * *